US010157583B2

(12) United States Patent
Huang et al.

(10) Patent No.: US 10,157,583 B2
(45) Date of Patent: Dec. 18, 2018

(54) DISPLAY APPARATUS AND DISPLAY CONTROL METHOD THEREOF

(71) Applicant: AU Optronics Corporation, Hsin-Chu (TW)

(72) Inventors: Shih-Ting Huang, Hsin-Chu (TW); Yu-Chin Chu, Hsin-Chu (TW); Sheng-Wen Cheng, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 142 days.

(21) Appl. No.: 15/415,056

(22) Filed: Jan. 25, 2017

(65) Prior Publication Data

US 2017/0221432 A1 Aug. 3, 2017

(30) Foreign Application Priority Data

Jan. 28, 2016 (TW) ..... 105102675 A

(51) Int. Cl.
*G09G 3/36* (2006.01)
*G09G 3/20* (2006.01)

(52) U.S. Cl.
CPC ..... *G09G 3/3607* (2013.01); *G09G 3/2003* (2013.01); *G09G 3/2074* (2013.01); *G09G 2300/0443* (2013.01); *G09G 2300/0452* (2013.01); *G09G 2320/0233* (2013.01)

(58) Field of Classification Search
CPC ..... H01L 27/3218; H01L 27/3276; H01L 27/156; H01L 27/3262; H01L 27/3216; G09G 3/3208; G09G 3/2074; G09G 3/2003; G09G 3/3225; G09G 2300/0426; G09G 2340/0457; G09G 2320/0666; G09G 2300/0465
See application file for complete search history.

(56) References Cited

U.S. PATENT DOCUMENTS 8,704,847 B2 4/2014 Higgins et al.
8,723,995 B2 * 5/2014 Schweng ..... H04N 5/2355 348/234
9,151,997 B2 10/2015 Tamaki et al.
(Continued)

FOREIGN PATENT DOCUMENTS

CN 104280938 A 1/2015

OTHER PUBLICATIONS

Elliott, C.H.B., Credelle, T.L., Higgins, M.F., "Adding a White Subpixel," Information Display, 26-31, (May 2005).*

*Primary Examiner* — Bryan Earles
(74) *Attorney, Agent, or Firm* — WPAT, PC

(57) ABSTRACT

A display apparatus includes a plurality of first pixel units and a plurality of second pixel units. Each of the first pixel units includes at least one first color sub-pixel, at least one second color sub-pixel, at least one third color sub-pixel and at least one fourth color sub-pixel arranged in a first configuration. Each of the second pixel units includes the at least one first color sub-pixel, the at least one second color sub-pixel, the at least one third color sub-pixel and the at least one fourth color sub-pixel arranged in a second configuration different from the first configuration. The first pixel units and the second pixel units are alternately disposed to make all of the pixel units adjacent to each of the first pixel units be the second pixel units, and all of the pixel units adjacent to each of the second pixel units be the first pixel units.

13 Claims, 7 Drawing Sheets

(56) References Cited

U.S. PATENT DOCUMENTS

| | | | | |
|---|---|---|---|---|
| 9,569,988 | B2 * | 2/2017 | Matsui | G09F 13/04 |
| 9,898,953 | B2 * | 2/2018 | Li | G09G 3/2003 |
| 2004/0114046 | A1 * | 6/2004 | Lee | H04N 9/67 348/279 |
| 2013/0229444 | A1 | 9/2013 | Teranishi et al. | |
| 2014/0307133 | A1 * | 10/2014 | Kawai | H04N 9/07 348/273 |
| 2015/0029358 | A1 * | 1/2015 | Kaizu | H04N 9/07 348/223.1 |
| 2015/0371605 | A1 * | 12/2015 | Wu | G09G 5/02 345/604 |
| 2016/0155776 | A1 * | 6/2016 | Kabe | H01L 27/3216 257/89 |

* cited by examiner

| | C1 | C4 | C2 | C2 | C3 | C4 |
|---|---|---|---|---|---|---|
| Vc | 0 | 0 | 0 | 0 | 0 | 0 |

| | C1 | C4 | C2 | C2 | C3 | C4 |
|---|---|---|---|---|---|---|
| Vc | 0 | 1 | 0 | 1 | 0 | 1 |

| | C1 | C4 | C2 | C2 | C3 | C4 |
|---|---|---|---|---|---|---|
| Vc | 1 | 0 | 1 | 0 | 1 | 0 |

| | C1 | C4 | C2 | C2 | C3 | C4 |
|---|---|---|---|---|---|---|
| Vc | 1 | 1 | 1 | 1 | 1 | 1 |

| | C1 | C1 | C2 | C4 | C3 | C3 |
|---|---|---|---|---|---|---|
| Vc | 0 | 0 | 0 | 0 | 0 | 0 |

| | C1 | C1 | C2 | C4 | C3 | C3 |
|---|---|---|---|---|---|---|
| Vc | 0 | 1 | 0 | 1 | 0 | 1 |

| | C1 | C1 | C2 | C4 | C3 | C3 |
|---|---|---|---|---|---|---|
| Vc | 1 | 0 | 1 | 0 | 1 | 0 |

| | C1 | C1 | C2 | C4 | C3 | C3 |
|---|---|---|---|---|---|---|
| Vc | 1 | 1 | 1 | 1 | 1 | 1 |

DISPLAY APPARATUS AND DISPLAY CONTROL METHOD THEREOF

BACKGROUND

Technical Field

The present disclosure relates to a display apparatus and a display control method thereof, and more particularly to a display apparatus that has high transmittance/reflectance and also maintains full color brightness and a display control method thereof.

Related Art

With the spread of electronic products, liquid crystal displays are massively applied to 3C products such as television sets, mobile phones, notebook computers and tablet computers. Especially in recent years, liquid crystal displays are further used in wearable apparatuses, for example, SmartWatch from Sony, iWatch from Apple, and Forerunner from Garmin. A wearable apparatus has advantages such as a small volume and portability; however, because of such a small volume, relatively, battery power of a wearable apparatus does not last long. A liquid crystal display screen on a wearable apparatus consumes a significant share of power, and therefore it becomes an important topic to make a liquid crystal display screen more power saving.

In a liquid crystal display screen, regardless of a transmissive display or a reflective display, to reduce power consumption of a backlight module during transmission of light rays, or to achieve readability during reflection of light rays, transmittance or reflectance of the display must be increased. Accordingly, in current methods, a white sub-pixel is added to red, green and blue sub-pixels to improve panel readability and reduce power consumption of a backlight module. However, for a white sub-pixel, a precise gray level control is still not obtainable. Therefore, full color brightness of a picture is reduced, and meanwhile, because of an excessively high proportion of white sub-pixels, when a picture is displayed, a washout phenomenon of overall colors occurs.

SUMMARY

An aspect of the present disclosure is to provide a display apparatus. The display apparatus includes a plurality of first pixel units and a plurality of second pixel units. Each of the first pixel units includes at least one first color sub-pixel, at least one second color sub-pixel, at least one third color sub-pixel and at least one fourth color sub-pixel arranged in a first configuration. Each of the second pixel units includes the at least one first color sub-pixel, the at least one second color sub-pixel, the at least one third color sub-pixel and the at least one fourth color sub-pixel arranged in a second configuration different from the first configuration. A color displayed by the second color sub-pixel is green. In the first configuration, a quantity of the second color sub-pixels is greater than quantities of the first color sub-pixels, the third color sub-pixels and fourth color sub-pixels. In the second configuration, a quantity of the second color sub-pixels is less than quantities of the first color sub-pixels and the third color sub-pixels. The first pixel units and the second pixel units are alternately disposed to make all of the pixel units adjacent to each of the first pixel units be the second pixel units, and all of the pixel units adjacent to each of the second pixel units be the first pixel units.

A next aspect of the present disclosure is to provide a display control method, applicable to the foregoing display apparatus. The display control method includes: controlling, according to a first-color gray level value, a second-color gray level value, a third-color gray level value and a fourth-color gray level value of a plurality of input signals, display of the first color sub-pixels, the second color sub-pixels, the third color sub-pixels and the fourth color sub-pixels in each of the first pixel units and each of the second pixel units, where when brightness displayed by each of the first pixel units or each of the second pixel units is lower than brightness of the corresponding input signals, display of the first color sub-pixels, the second color sub-pixels, the third color sub-pixels or the fourth color sub-pixels in the second pixel units adjacent to each of the first pixel units or the first pixel units adjacent to each of the second pixel units is controlled.

In conclusion, for the display apparatus of the present disclosure, not only fourth color sub-pixels are disposed to increase transmittance/reflectance, but also because the fourth color sub-pixels are disposed in a scattered manner to make a proportion of the fourth color sub-pixels be relatively close to proportions of other color sub-pixels, full color brightness of a picture is maintained. In addition, in some embodiments, display of colors and images is optimized by using the display control method, so that a washout phenomenon of overall colors that occurs when a picture is displayed is avoided.

BRIEF DESCRIPTION OF THE DRAWINGS

To make the foregoing and other objectives, features, and advantages of the present invention and the embodiments more comprehensible, the accompanying drawings are described as follows.

DETAILED DESCRIPTION

The following discloses and provides many different embodiments or examples used to implement different features of the present invention. Elements and configurations in special examples are used in the following discussion to simplify the present disclosure. Any discussed example is only used for illustrative purposes, and does not limit the scope and meaning of the present invention or examples of the present invention in any manner. In addition, numerical symbols and/or letters may be repeatedly used in different examples of the present disclosure, and all these repetitions are for simplification and description, and do not specify relationships between different embodiments and/or configurations in the following discussion.

The terms used in the entire specification and the claims, unless specifically indicated, usually have common meanings of the terms used in the art and in the disclosed content and special content. Some terms used to describe the present disclosure are discussed below or somewhere else in this specification, so as to provide additional guidance in the description of the present disclosure to a person skilled in the art.

"Coupling" or "connecting" used herein may both refer to that two or more elements are in direct physical or electrical contact, or are in indirect physical or electrical contact, while "coupling" or "connecting" may also refer to that two or more elements are interoperable or interacting. Herein, it may be understood that words such as first, second and third are used to describe various elements, components, areas, layers and/or blocks. However, these elements, components, areas, layers and/or blocks should not be limited by these terms. These words are only used for distinguishing between single elements, components, areas, layers and/or blocks. Therefore, a first element, component, area, layer and/or block hereinafter may also be referred to as a second element, component, area, layer and/or block without departing from the concept of the present invention. As used herein, the words "and/or" include one of the listed items or any combination of multiple of the listed items.

Figure 1:
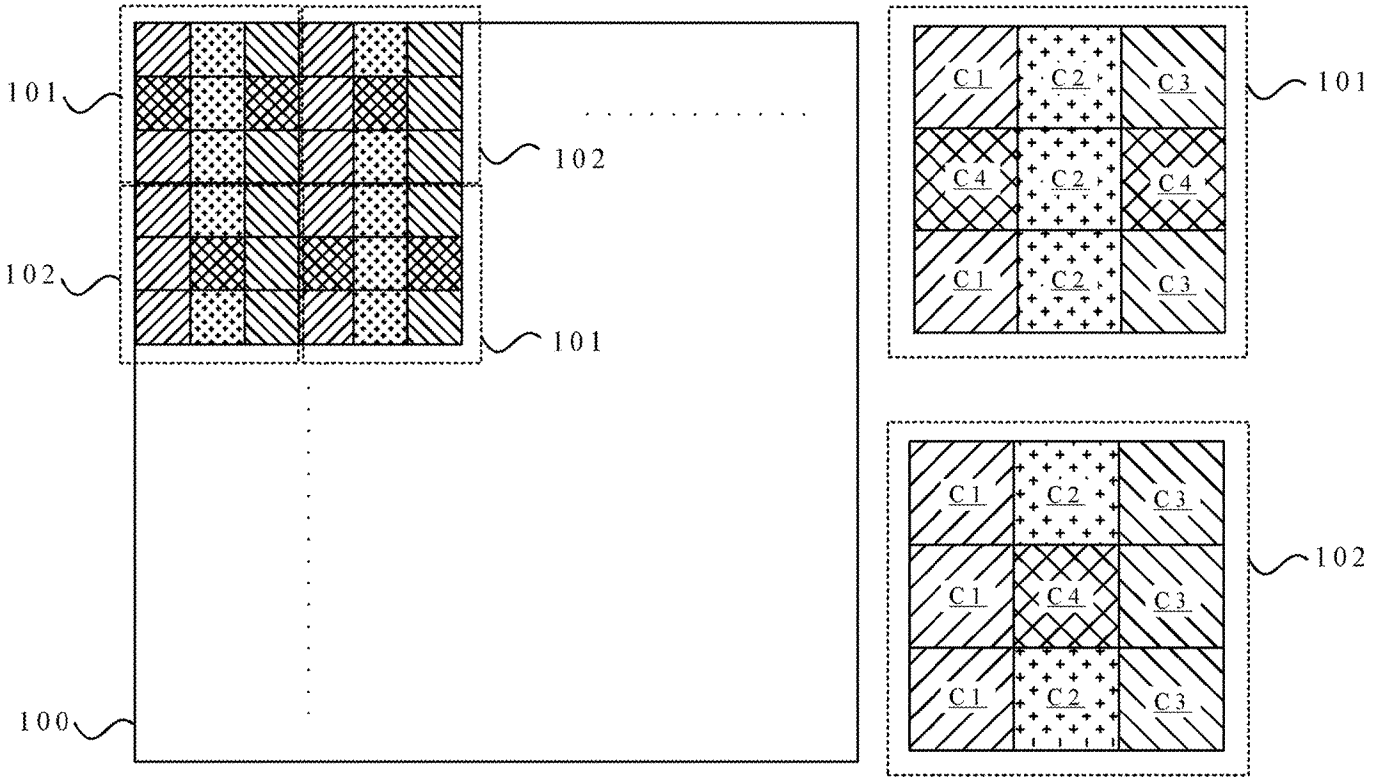
FIG. 1 is a schematic diagram of a display apparatus according to an embodiment of the present disclosure.

Referring to FIG. 1, FIG. 1 is a schematic diagram of a display apparatus 100 according to an embodiment of the present disclosure. In some embodiments, the display apparatus 100 may be a display screen applied in a television set, a computer, a tablet computer or a wearable apparatus, and the present disclosure is not limited thereto.

The display apparatus 100 includes a plurality of first pixel units 101 and a plurality of second pixel units 102. Each of the first pixel units 101 includes at least one first color sub-pixel C1, at least one second color sub-pixel C2, at least one third color sub-pixel C3 and at least one fourth color sub-pixel C4 arranged in a first configuration. Each of the second pixel units includes the at least one first color sub-pixel C1, the at least one second color sub-pixel C2, the at least one third color sub-pixel C3 and the at least one fourth color sub-pixel C4 arranged in a second configuration different from the first configuration. The first pixel units 101 and the second pixel units 102 are alternately disposed to make all of the pixel units adjacent to each of the first pixel units 101 be the second pixel units 102, and all of the pixel units adjacent to each of the second pixel units 102 be the first pixel units 101.

Furthermore, as shown in FIG. 1, in this embodiment, each of the first pixel units 101 or each of the second pixel units 102 includes 9 sub-pixel blocks used to dispose the first color sub-pixel C1, the second color sub-pixel C2, the third color sub-pixel C3 and the fourth color sub-pixel C4. Colors displayed by the first color sub-pixel C1, the second color sub-pixel C2, the third color sub-pixel C3 and the fourth color sub-pixel C4 may be respectively red, green, blue and white. However, in an actual application, a quantity of the sub-pixel blocks included in each of the first pixel units 101 and the second pixel units 102 is not limited to 9. Each of the first pixel units 101 or each of the second pixel units 102 includes $3\times(2^N-1)$ sub-pixel blocks, where N is a positive integer greater than or equal to 2, that is, may include 21 (=3×7) sub-pixel blocks, 45 (=3×15) sub-pixel blocks, or another quantity of sub-pixel blocks. The colors displayed by the first color sub-pixel C1, the second color sub-pixel C2, the third color sub-pixel C3 and the fourth color sub-pixel C4 are also not limited to the foregoing red, green, blue and white, and may be, for example, cyan, magenta, yellow or any other color instead.

As shown in FIG. 1, in this embodiment, when N=2, 9 sub-pixel blocks in each of the first pixel units 101 or each of the second pixel units 102 are arranged in 3 rows and 3 columns. The first color sub-pixels C1 of each of the first pixel units 101 are disposed in the first row and first column and in the third row and first column. The second color sub-pixels C2 of each of the first pixel units 101 are disposed in the first row and second column, in the second row and second column and in the third row and second column. The third color sub-pixels C3 of each of the first pixel units 101 are disposed in the first row and third column and in the third row and third column. The fourth color sub-pixels C4 of each of the first pixel units 101 are disposed in the second row and first column and in the second row and third column. The first color sub-pixels C1 of each of the second pixel units 102 are disposed in the first row and first column, in the second row and first column and in the third row and first column. The second color sub-pixels C2 of each of the second pixel units 102 are disposed in the first row and second column and in the third row and second column. The third color sub-pixels C3 of each of the second pixel units 102 are disposed in the first row and third column, in the second row and third column and in the third row and third column. The fourth color sub-pixel C4 of each of the second pixel units 102 is disposed in the second row and second column. It should be noted that although in this embodiment, the foregoing arrangement is used as an example to describe an arrangement of the sub-pixels in the first pixel units 101 and the second pixel units 102, in an actual application, the arrangement of the sub-pixels in the first pixel units 101 and the second pixel units 102 may be adjusted in consideration of a scenario in which the display apparatus 100 is used, for example, may be adjusted to an arrangement in which the first color sub-pixels C1 and the second color sub-pixels C2 are switched, or an arrangement in which the second color sub-pixels C2 and the third color sub-pixels C3 are switched, the present disclosure is not limited thereto.

In this embodiment, in the first configuration, quantities of the first color sub-pixels C1, the second color sub-pixels C2, the third color sub-pixels C3 and the fourth color sub-pixels C4 are 2, 3, 2 and 2, respectively. In the second configuration, quantities of the first color sub-pixels C1, the second color sub-pixels C2, the third color sub-pixels C3 and the fourth color sub-pixels C4 are 3, 2, 3 and 1, respectively. That is, the quantities of the first color sub-pixels C1, the third color sub-pixels C3 and the fourth color sub-pixels C4 in the first configuration are equal. In the second configuration, the quantity of the fourth color sub-pixels C4 is less than the quantity of the second color sub-pixels C2. In the first configuration, the quantity of the second color sub-pixels C2 is greater than the quantities of the first color sub-pixels C1, the third color sub-pixels C3 and the fourth color sub-pixels C4. In the second configuration, the quantity of the second color sub-pixels C2 is less than the quantities of the first color sub-pixels C1 and the third color sub-pixels C3. In other words, in this example, a green-rich picture is displayed in the first configuration, and a green-insufficient picture is displayed in the second configuration. In this way, the alternately disposed first pixel units 101 and second pixel units 102 may be suitable for human eyes that are relatively sensitive to green light. However, in an actual application, quantities of the first color sub-pixels C1, the second color sub-pixels C2, the third color sub-pixels C3 and the fourth color sub-pixels C4 in the first configuration are not limited to the foregoing numerical values. That is, the quantities of the sub-pixels in the first configuration and the second configuration may be changed in consideration of a scenario in which the display apparatus 100 is used. For example, a red-rich picture is displayed in the first configuration, and a red-insufficient picture is displayed in the second configuration. For another example, a blue-rich picture is displayed in the first configuration, and a blue-insufficient picture is displayed in the second configuration.

It should be noted that, in this embodiment, one first pixel unit 101 and one second pixel unit 102 may be seen as one smallest repetitive unit, and the entire display apparatus 100 may be formed of such smallest repetitive units. However, in an actual application, any quantities of the first pixel units 101 and the second pixel units 102 in different configurations may be seen as the smallest repetitive unit to form the entire display apparatus 100, and the present disclosure is not limited thereto.

In addition, in this embodiment, the fourth color sub-pixels C4 in the first pixel units 101 and the second pixel units 102 are not adjacent to each other, so that display of white in a picture is evenly scattered. However, in an actual application, an adjustment may also be made in consideration of a scenario in which the display apparatus 100 is used to make the fourth color sub-pixels C4 in the first pixel units 101 and the second pixel units 102 be adjacent to each other. It is considered that brightness of display (white) of a single fourth color sub-pixel C4 is equivalent to brightness of joint display of one first color sub-pixel C1 (red), one second color sub-pixel C2 (green) and one third color sub-pixel C3 (blue). Therefore, in the present disclosure, fourth color sub-pixels are disposed in the display apparatus to increase transmittance/reflectance, so that in an application to a transmissive display, readability in sunlight or intense light may be ensured without increasing brightness of a backlight module, thereby greatly reducing power consumption of the backlight module, while in an application to a reflective display, an image becomes more distinctive when ambient brightness is high and readable brightness for human eyes can be achieved at a relatively low ambient brightness. On the other hand, because fourth color sub-pixels are disposed in a scattered manner to make proportions of the fourth color sub-pixels and other color sub-pixels be relatively close, full color brightness of a picture is maintained.

Figure 2:
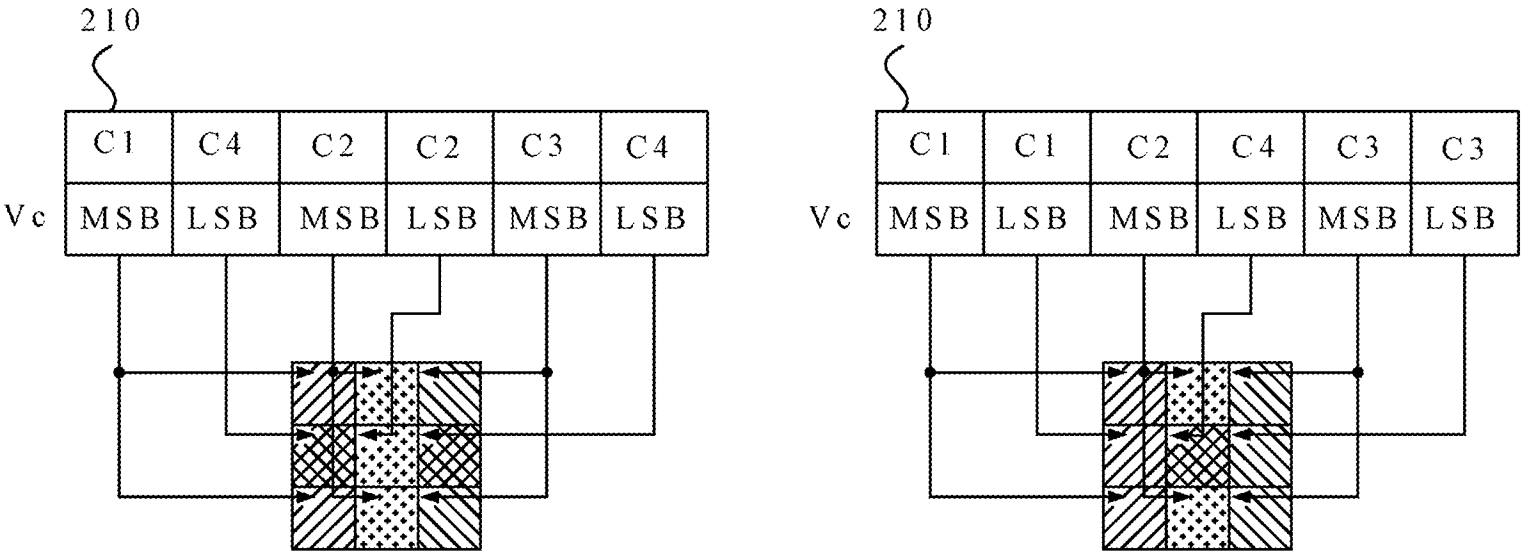
FIG. 2 is a schematic diagram of a display controller according to an embodiment of the present disclosure.

In some embodiments, the display apparatus 100 further includes a display controller 210. Herein, referring to FIG. 2, FIG. 2 is a schematic diagram of the display controller 210 according to an embodiment of the present disclosure. As shown in FIG. 2, corresponding to each of the first pixel units C1 and each of the second pixel units C2, the display controller 210 is used to correspondingly control, according to a control signal Vc of 6 bits, display of the first color sub-pixels C1, the second color sub-pixels C2, the third color sub-pixels C3 and the fourth color sub-pixels C4 in each of the first pixel units 101 and each of the second pixel units 102. In an actual application, the control signal Vc may be connected to an transistor used to control display of each sub-pixel. However, in an actual application, a quantity of bits of the control signal Vc used by the display controller 210 is not limited to 6. The display controller 210 is used to correspondingly control, according to a control signal Vc of 3×N bits, display of the first color sub-pixels C1, the second color sub-pixels C2, the third color sub-pixels C3 and the fourth color sub-pixels C4 in each of the first pixel units 101 and each of the second pixel units 102, where N is a positive integer greater than or equal to 2. That is, for example, the display of the first color sub-pixels C1, the second color sub-pixels C2, the third color sub-pixels C3 and the fourth color sub-pixels C4 in each of the first pixel units 101 and each of the second pixel units 102 is correspondingly controlled according to a control signal Vc of 9 (=3×3) bits, a control signal Vc of 12 (=3×4) bits, or a control signal Vc of another quantity of bits.

Furthermore, in this embodiment, when N=2, 9 sub-pixel blocks in each of the first pixel units 101 or each of the second pixel units 102 are arranged in 3 rows and 3 columns, 3 first bits LSB in the control signal Vc of 6 bits are used to control display of the second rows in each of the first pixel units 101 and each of the second pixel units 102, and 3 second bits MSB in the control signal Vc of 6 bits are used to control display of the first rows and the third rows in each of the first pixel units 101 and each of the second pixel units 102. It may be seen that the 3 first bits LSB in the control signal Vc are respectively used to control sub-pixel blocks in the second row and first column, in the second row and second column and in the second row and third column in the first pixel units 101 or the second pixel units 102, that is, the fourth color sub-pixel C4, the second color sub-pixel C2 and the fourth color sub-pixel C4 in the first pixel units 101, and the first color sub-pixel C1, the fourth color sub-pixel C4 and the third color sub-pixel C3 in the second pixel units 102. On the other hand, the 3 second bits MSB in the control signal Vc are respectively used to control the rest sub-pixel blocks in the first pixel units 101 and the second pixel units 102.

Figure 3A:
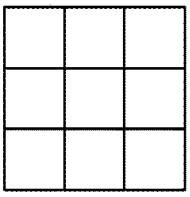
FIG. 3A is a schematic diagram of the display controller in FIG. 2 operating a first pixel unit.
Figure 3A:
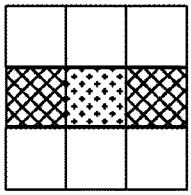
Figure 3A:
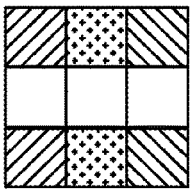
Figure 3A:
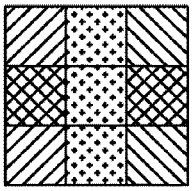
Figure 3B:
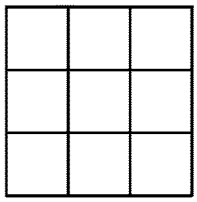
FIG. 3B is a schematic diagram of the display controller in FIG. 2 operating a second pixel unit.
Figure 3B:
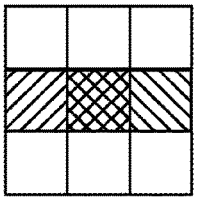
Figure 3B:
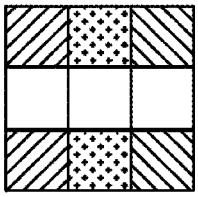
Figure 3B:
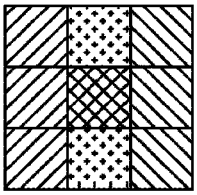

Schematic diagrams about detailed operations of the display controller 210 may be seen in FIG. 3A and FIG. 3B. Herein, referring to FIG. 3A and FIG. 3B together, FIG. 3A is a schematic diagram of the display controller 210 in FIG. 2 operating a first pixel unit 101, and FIG. 3B is a schematic diagram of the display controller 210 in FIG. 2 operating a second pixel unit 102. As shown in FIG. 3A, when the 6 bits in the control signal Vc are all disabled, where an example in which the control signal Vc is a digital signal is used, a disable level is a logic low level (0), and an enable level is a logic high level (1), none of the sub-pixel blocks in the first pixel unit 101 is displayed. When in the control signal Vc, the 3 first bits LSB are enabled and the 3 second bits MSB are disabled, the first pixel unit 101 correspondingly enables the sub-pixel blocks in the second row and first column (the fourth color sub-pixel C4), in the second row and second column (the second color sub-pixel C2) and in the second row and third column (the fourth color sub-pixel C4) of the first pixel unit 101 to perform display. When in the control signal Vc, the 3 first bits LSB are disabled and the 3 second bits MSB are enabled, the first pixel unit 101 correspondingly enables the sub-pixel blocks in the first row and first column (the first color sub-pixel C1), in the first row and second column (the second color sub-pixel C2) and in the first row and third column (the third color sub-pixel C3), in the third row and first column (the first color sub-pixel C1), in the third row and second column (the second color sub-pixel C2) and in the third row and third column (the third color sub-pixel C3) of the first pixel unit 101 to perform display. When all the 6 bits in the control signal Vc are enabled, the first pixel unit 101 correspondingly enables each sub-pixel block to perform display. Similarly, a case in which the display controller 210 operates the second pixel unit 102 is shown in FIG. 3B, and is no longer described in detail herein. It should only be noted that in FIG. 3A and FIG. 3B, an example in which the 3 first bits LSB in the control signal Vc are simultaneously enabled/disabled or the 3 second bits MSB are simultaneously enabled/disabled is only used for ease of description; however, in an actual application, the 6 bits in the control signal Vc may all be independently controlled, and the present invention is not limited to the foregoing example.

Figure 4:
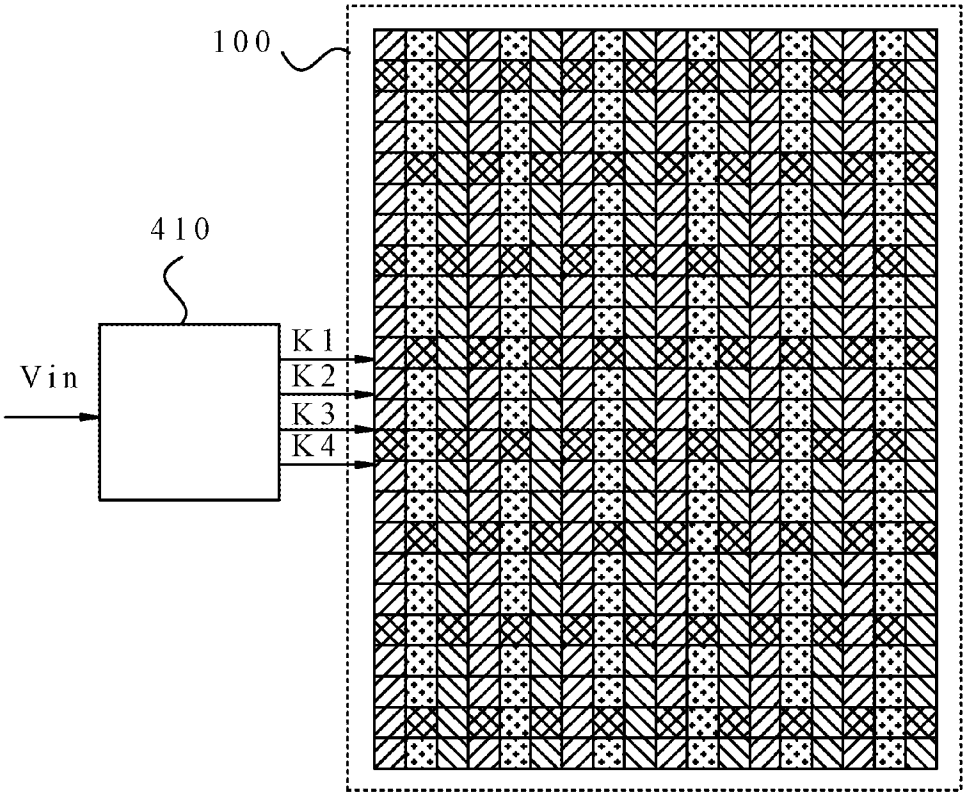
FIG. 4 is a schematic diagram of a display control method according to an embodiment of the present disclosure.

In addition, referring to FIG. 4, the present disclosure additionally discloses a display control method 400. The display control method 400 is applicable to the foregoing display apparatus 100. However, in an actual application, the display control method 400 is applicable to any other display, and the present disclosure is not limited thereto. FIG. 4 is a schematic diagram of the display control method 400 according to an embodiment of the present disclosure. For ease of description, a case in which the display control method 400 is applied to the display apparatus 100 is described below. The display control method 400 includes: performing Step S410 by using a control unit 410: controlling, according to a first-color gray level value K1, a second-color gray level value K2, a third-color gray level value K3 and a fourth-color gray level value K4 of a plurality of input signals Vin, display of the first color sub-pixels C1, the second color sub-pixels C2, the third color sub-pixels C3 and the fourth color sub-pixels C4 in each of the first pixel units 101 and each of the second pixel units 102, where when brightness displayed by each of the first pixel units 101 or each of the second pixel units 102 is lower than brightness of the corresponding input signals Vin, display of the first color sub-pixels C1, the second color sub-pixels C2, the third color sub-pixels C3 or the fourth color sub-pixels C4 in the second pixel units 102 adjacent to each of the first pixel units 101 or the first pixel units 101 adjacent to each of the second pixel units 102 is controlled.

Furthermore, in this embodiment, the plurality of input signals Vin may respectively correspond to display signals of each of the first pixel units 101 or each of the second pixel units 102, where the first-color gray level value K1, the second-color gray level value K2, the third-color gray level value K3 and the fourth-color gray level value K4 may be respectively gray level values displayed corresponding to red, green, blue and white. That is, different colors have corresponding brightness that needs to be displayed, where when a gray level value is larger, it represents that brightness that needs to be displayed by the color is higher, and a quantity of sub-pixels of the first pixel unit 101 or the second pixel unit 102 that correspondingly need to perform display is larger. For example, when a first-color gray level value K1, a second-color gray level value K2, a third-color gray level value K3 and a fourth-color gray level value K4 of an input signal Vin received by any of the first pixel units 101 or the second pixel units 102 are respectively 2, 1, 1 and 1, 2 first color sub-pixels C1, 1 second color sub-pixel C2, 1 third color sub-pixel C3 and 1 fourth color sub-pixel C4 correspondingly perform display, to make brightness of red displayed by the first pixel unit 101 or the second pixel unit 102 be higher than brightness of green, brightness of blue and brightness of white. That is, in the present disclosure, input signals of different gray level values are correspondingly displayed by displaying different quantities of sub-pixels in the first pixel unit 101 and the second pixel unit 102. However, it should be noted that when the display apparatus 100 discussed above controls, by using the display controller 210, display of the first pixel unit 101 and the second pixel unit 102, a case in which the first-color gray level value K1, the second-color gray level value K2, and the third-color gray level value K3 of relatively low levels are relatively difficult to display occurs. That is, the minimum brightness performance of the first color sub-pixel C1 and the third color sub-pixel C3 in the first pixel unit 101 is display of two sub-pixel blocks; therefore, for the first-color gray level value K1 and the third-color gray level value K3 of relatively low levels, it is relatively difficult to display brightness of red and brightness of blue corresponding to the first-color gray level value K1 and the third-color gray level value K3. Similarly, the minimum brightness performance of the second color sub-pixel C2 in the second pixel unit 102 is display of two sub-pixel blocks; therefore, for the second-color gray level value K2 of a relatively low level, it is relatively difficult to display brightness of green corresponding to the second-color gray level value K2. Therefore, in this embodiment, by using different arrangements of the first pixel units 101 and the second pixel units 102, the first pixel units 101 and the second pixel units 102 may mutually provide compensation to pixel units that cannot perform display, and for specific implementation, reference may be further made to FIG. 5.

Figure 5:
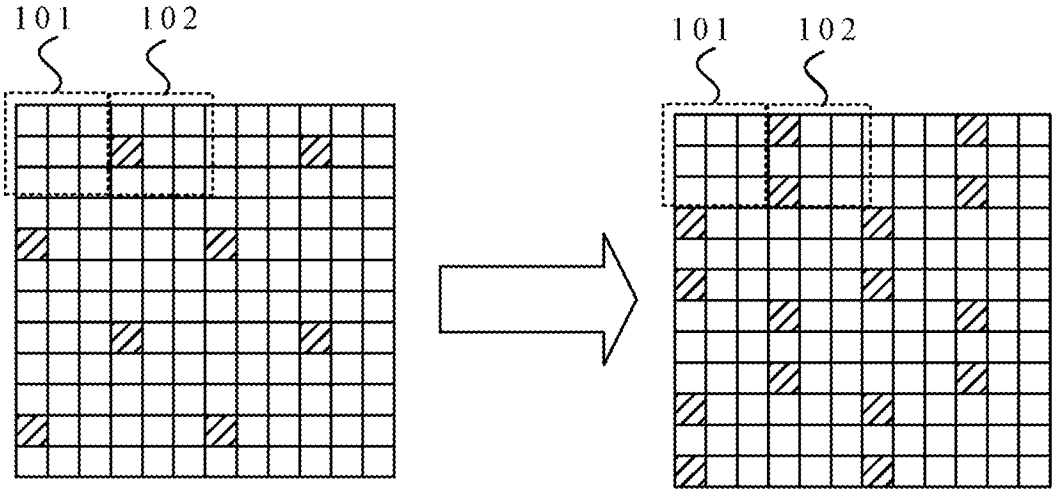
FIG. 5 is a schematic diagram of a display control method according to an embodiment of the present disclosure.

Referring to FIG. 5, FIG. 5 is a schematic diagram of the display control method 400 according to an embodiment of the present disclosure. In some embodiments, Step S410 above further includes: performing Step S411 to Step S413. Step S411: When one of the first pixel units 101 or the second pixel units 102 cannot display a first-color gray level value K1, a second-color gray level value K2 or a third-color gray level value K3 of the corresponding input signals Vin, save, in a storage unit(not shown), the first-color gray level value K1, the second-color gray level value K2 or the third-color gray level value K3 of the pixel unit that cannot be displayed. Step S412: Adjust, according to the first-color gray level value K1, the second-color gray level value K2 or the third-color gray level value K3 in the storage unit, a first-color gray level value K1, a second-color gray level value K2 or a third-color gray level value K3 corresponding to another pixel unit adjacent to the pixel unit that cannot be displayed. Step S413: Enable, according to the adjusted first-color gray level value K1, second-color gray level value K2 or third-color gray level value K3, the another pixel unit adjacent to the pixel unit that cannot perform display to perform display according to the adjusted first-color gray level value K1, the adjusted second-color gray level value K2 or the adjusted third-color gray level value K3, so as to provide compensation to the pixel unit that cannot perform display.

According to one embodiment, when the second-color gray level value K2, the third-color gray level value K3 and the fourth-color gray level value K4 of the input signal Vin received by each of the first pixel units 101 or each of the second pixel units 102 are all 0, and the first-color gray level value K1 received by each of the first pixel units 101 or each of the second pixel units 102 are a numerical value of a relatively low level, for example, 1, because the minimum brightness performance of the first color sub-pixel C1 in the first pixel units 101 is displayed bytwo sub-pixel blocks, for the first-color gray level value K1 of a relatively low level, brightness of red corresponding to the first-color gray level value K1 cannot be displayed, and in Step S411, the first-color gray level value K1 that cannot be displayed in each of the first pixel units 101 is saved in the storage unit. In Step S412, according to the first-color gray level value K1 in the storage unit, a first-color gray level value K1 corresponding to another pixel unit adjacent to each of the first pixel units 101 that cannot perform display is further adjusted. For example, a first-color gray level value K1 of any second pixel unit 102 on the right side, left side, upper side or lower side of each of the first pixel units 101 is adjusted from the original 1 to 2. Finally, in Step S413, the another second pixel unit 102 adjacent to each of the first pixel units 101 that cannot perform display performs display according to the adjusted first-color gray level value K1, so as to provide compensation to the pixel unit that cannot perform display. As shown on the left side of FIG. 5, originally an input signal received by the second pixel unit 102 is a first-color gray level value K1 of a low level and therefore only the first color sub-pixel C1 in the second row and first column of the second pixel unit 102 needs to perform display; however, after Step S411 to Step S413 above, it may be seen that the second pixel units 102 adjacent to each of the first pixel units 101 correspondingly enable, according to the adjusted first-color gray level value K1, the first color sub-pixels C1 in the first row and first column and in the third row and first column to perform display, as shown on the right side in FIG. 5. Therefore, an overall picture of the display apparatus 100 maintains brightness of a first color (red). In another embodiment, when the second pixel unit 102 receives a second-color gray level value K2 of a relatively low level or the first pixel unit 101 receives a third-color gray level value K3 of a relatively low level, Step S411 to Step S413 above may also be performed to provide compensation to maintain brightness of a second color (green) and brightness of a third color (blue), so that display of colors and images is optimized by using the display control method, thereby avoiding a washout phenomenon of overall colors that occurs when a picture is displayed.

Figure 6:
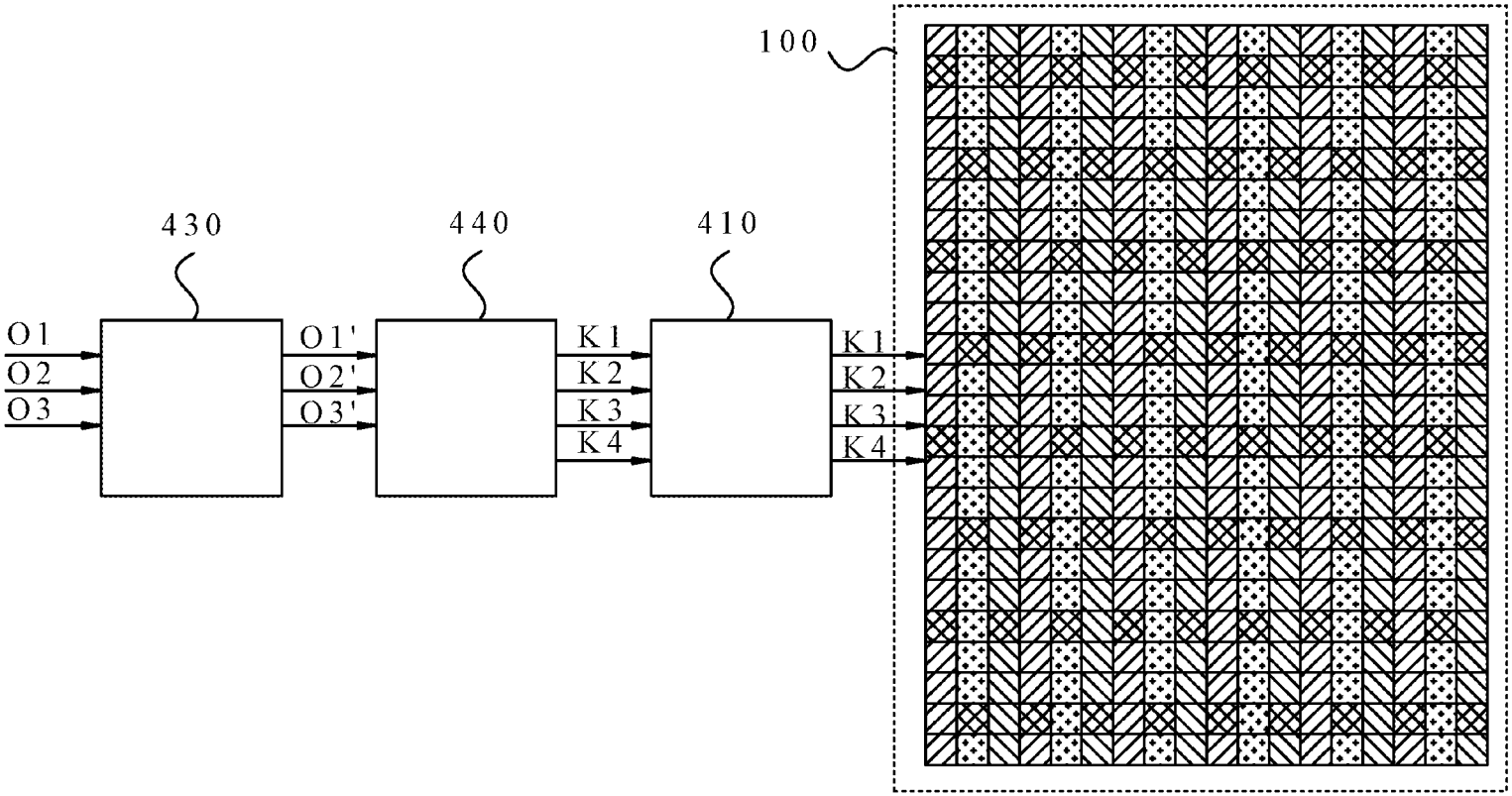
FIG. 6 is a schematic diagram of a display control method according to an embodiment of the present disclosure.

Referring to FIG. 6, FIG. 6 is a schematic diagram of the display control method 400 according to an embodiment of the present disclosure. In some embodiments, the display control method 400 further includes: Perform Step S420, Step S430 and Step S440: Perform Step S420 by using a control unit 430: Receive input signals Vin, where the input signals Vin respectively correspond to the first pixel units 101 and the second pixel units 102, and each input signal Vin has a first original-color gray level value O1, a second original-color gray level value O2 and a third original-color gray level value O3. Next, perform Step S430 by using a control unit 440: Adjust the first original-color gray level value O1, the second original-color gray level value O2, and the third original-color gray level value O3 of the input signals Vin according to a maximum brightness value Max. Perform Step S440 by using the control unit 440: Perform color analysis on the adjusted first original-color gray level value O1', second original-color gray level value O2', and third original-color gray level value O3', to generate the first-color gray level value K1, the second-color gray level value K2, the third-color gray level value K3 and the fourth-color gray level value K4. In some embodiments, Step S420 further includes an operation of performing pure color confirmation by the control unit 430, that is, the control unit 430 confirms whether the input signals Vin are pure color of, for example, one of red, green, blue, cyan, magenta and yellow. If the input signals Vin are determined to be pure color, the Step S430 and 5440 are bypassed. In one embodiment, if one of the first original-color gray level value O1, the second original-color gray level value O2 and the third original-color gray level value O3 of the input signals Vin is 0, in subsequent Step S430 and S440, the rest processing is not performed on the input signals Vin, and the input signals Vin are sent to the subsequent control unit 410 to maintain full color brightness of the input signals Vin.

For example, numerical values are used for description. In Step S420, a first original-color gray level value O1, a second original-color gray level value O2 and a third original-color gray level value O3 of an input signal Vin received by any first pixel unit 101 or second pixel unit 102 are respectively 3, 2 and 2, and may be gray level values that respectively correspond to red, green and blue. In consideration of that brightness of display (white) of a single fourth color sub-pixel C4 in the display apparatus 100 is equivalent to brightness of joint display of one first color sub-pixel C1 (red), one second color sub-pixel C2 (green) and one third color sub-pixel C3 (blue), to reach maximum brightness during an application to the display apparatus 100, a brightness maximum value Max is set to 8, and for 8 here, it is considered that the maximum brightness of a first color (red), a second color (green) or a third color (blue) that can be equivalently displayed by the smallest repetitive unit (that is, one first pixel unit 101 plus one second pixel unit 102) discussed above is to simultaneously enable 3 fourth color sub-pixels C4 to perform display and enable the rest 5 first color sub-pixels C1 (red), second color sub-pixels C2 (green) and third color sub-pixels C3 (blue) to perform display. Therefore, in Step S430, the foregoing first original-color gray level value O1, second original-color gray level value O2 and third original-color gray level value O3 are adjusted from the original 3, 2 and 2 to 8, 5 and 5 according to the brightness maximum value Max. Finally, in Step S440, color analysis is performed on the adjusted first original-color gray level value O1', second original-color gray level value O2' and third original-color gray level value O3' of the input signals Vin, to generate the first-color gray level value K1, the second-color gray level value K2, the third-color gray level value K3 and the fourth-color gray level value K4. That is, here it is similarly considered that the smallest repetitive unit (that is, one first pixel unit 101 plus one second pixel unit 102) can at most only display 3 fourth color sub-pixels C4; therefore, it is found through analysis that the minimum value 5 of the first original-color gray level value O1', the second original-color gray level value O2' and the third original-color gray level value O3' is still greater than 3. Therefore, the first-color gray level value K1, the second-color gray level value K2, the third-color gray level value K3 and the fourth-color gray level value K4 whose numerical values are respectively 5, 2, 2 and 3 are correspondingly generated. The foregoing numerical values are only for ease of description, and may be other random numerical values in an actual application, and the present disclosure is not limited thereto.

The foregoing example includes sequential exemplary steps, but these steps are not necessarily performed in a shown order. The performing of these steps in different orders is within the scope of the present disclosure. In addition, within the spirit and scope of the embodiments of the present disclosure, steps may be added, replaced, or an order of these steps may be changed and/or these steps may be omitted if necessary.

In conclusion, for the display apparatus of the present disclosure, fourth color sub-pixels are disposed to increase transmittance/reflectance, and on the other hand, the fourth color sub-pixels are disposed in a scattered manner to make the proportions of the fourth color sub-pixels and other color sub-pixels be relatively close, thereby maintaining full color brightness of a picture. In addition, in some embodiments, display of colors and images is optimized by using the display control method, so that a washout phenomenon of overall colors that occurs when a picture is displayed is avoided.

Although the present disclosure is disclosed as above by using the implementation manners, the implementation manners are not used to limit the present disclosure. Any person skilled in the art may make various variations and modifications without departing from the spirit and scope of the present disclosure, and therefore the protection scope of the present disclosure should be as defined by the appended claims.

What is claimed is:

1. A display apparatus, comprising:

a plurality of first pixel units in a first configuration; and a plurality of second pixel units in a second configuration;

wherein each of the first pixel units and the second pixel units comprises sub-pixels in a first color, a second color, a third color, and a fourth color;

wherein the first configuration provides that there are more sub-pixels in the second color than the first color, the third color, and the fourth color;

wherein, the second configuration provides that there are less sub-pixels in second color than the first color and the third color;

wherein the second color is green; and wherein, the plurality of the first pixel units and the plurality of the second pixel units are arranged alternately, and each of the first pixel units is adjacent to one of the second pixel units.

2. The display apparatus according to claim 1, wherein the first color is red, the third color is blue, and the fourth color is white.

3. The display apparatus according to claim 2, wherein the sub-pixel in the fourth color of first pixel unit and the sub-pixel in the fourth color of the second pixel unit are not adjacent to each other.

4. The display apparatus according to claim 2, wherein the first configuration provides equal sub-pixels for the first color, the third color, and the fourth color.

5. The display apparatus according to claim 2, wherein the second configuration provides less sub-pixels in the fourth color than the second color.

6. The display apparatus according to claim 2, wherein each of the first pixel units or each of the second pixel units comprises $3\times(2^N-1)$ sub-pixel blocks for accommodating the sub-pixels, wherein N is a positive integer greater than or equal to 2.

7. The display apparatus according to claim 6, further comprising a display controller to correspondingly control, according to a control signal of 3×N bits, display of the sub-pixels in each of the first pixel units and each of the second pixel units.

8. The display apparatus according to claim 7, wherein when N=2, each of the first pixel units and the second pixel units has 9 sub-pixel blocks arranged in 3 rows and 3 columns; and wherein the control signal has 6 bits, first 3 bits control display of a second row in each of the first pixel units and the second pixel units, and second 3 bits control display of a first row and a third row in each of the first pixel units and the second pixel units.

9. The display apparatus according to claim 6, wherein when N=2, each of the first pixel units and the second pixel units has 9 sub-pixel blocks arranged in a first row, a second row, a third row, a first column, a second column, and a third column;

wherein each of the first pixel units has sub-pixels in the first color located at where the first row and the first column intersect and wherein where the third row and the first column intersect;

wherein each of the first pixel units has sub-pixels in the second color located at where the first row and the second column intersect, where the second row and the second column intersect, and wherein the third row and the second column intersect; and wherein, each of the first pixel units has sub-pixels in the third color located at where the first row and the third column intersect, and where the third row and the third column intersect; and wherein each of the first pixel units has sub-pixels in the fourth color located at where the second row and the first column intersect and wherein the second row and the third column intersect.

10. The display apparatus according to claim 9, wherein each of the second pixel units has sub-pixels in the first color located at where the first row and the first column intersect, where the second row and the first column intersect, and where the third row and the first column intersect;

wherein each of the second pixel units has sub-pixels in the second color located at where the first row and second column intersect and where the third row and the second column intersect;

wherein each of the second pixel units has sub-pixels in the third color located at where the first row and the third column intersect, wherein the second row and the third column intersect, and where the third row and the third column intersect;

wherein each of the second pixel units has sub-pixels in the fourth color located at where the second row and the second column intersect.

11. A display control method, applicable to the display apparatus according to claim 1, the display control method comprising:

controlling, according to a first-color gray level value, a second-color gray level value, a third-color gray level value and a fourth-color gray level value of a plurality of input signals, the sub-pixels in each of the first pixel units and each of the second pixel units;

where i n the sub-pixels in each of the first pixel units and the second pixel units, which is adjacent to a neighboring pixel unit display a lower brightness than a corresponding input signals.

12. The display control method according to claim 11, further comprising:

saving the first-color gray level value, the second-color gray level value, or the third-color gray level value for one of the first pixel units in a storage unit when the one of the first pixel units cannot display the first-color gray level value, the second-color gray level value, or the third-color gray level value; and compensating the one of the first pixel units cannot display by adjusting the first-color gray level value, the second-color gray level value or the third-color gray level value corresponding to one of the second pixel units adjacent to the one of the first pixel units cannot perform display according to saved first-color gray level value, saved second-color gray level value, or saved third-color gray level value in the storage unit.

13. The display control method according to claim 11, further comprising:

receiving the input signals, corresponding to the first pixel units and the second pixel units, wherein each of the input signals has a first original-color gray level value, a second original-color gray level value and a third original-color gray level value;

adjusting the first original-color gray level value, the second original-color gray level value, and the third original-color gray level value according to a maximum brightness value; and generating the first-color gray level value, the second-color gray level value, the third-color gray level value, and the fourth-color gray level value by performing a color analysis on an adjusted first original-color gray level value, the second original-color gray level value, and the third original-color gray level value.

* * * * *